United States Patent [19]

Rowe

[11] Patent Number: 5,032,357

[45] Date of Patent: Jul. 16, 1991

[54] TRI-TITANIUM ALUMINIDE ALLOYS CONTAINING AT LEAST EIGHTEEN ATOM PERCENT NIOBIUM

[75] Inventor: Raymond G. Rowe, Schenectady, N.Y.

[73] Assignee: General Electric Company, Schenectady, N.Y.

[21] Appl. No.: 325,738

[22] Filed: Mar. 20, 1989

[51] Int. Cl.[5] ..... C22C 14/00

[52] U.S. Cl. ..... 420/418; 420/421; 420/426; 420/580

[58] Field of Search ..... 420/417, 418, 421, 580, 420/426

[56] References Cited

U.S. PATENT DOCUMENTS

| | | | |
|---|---|---|---|
| 3,411,901 | 11/1968 | Winter | 75/175.5 |
| 4,292,077 | 9/1981 | Blackburn et al. | 148/11.5 F |
| 4,716,020 | 12/1987 | Blackburn et al. | 420/418 |
| 4,746,374 | 5/1988 | Froes et al. | 148/11.5 F |
| 4,788,035 | 11/1988 | Gigliotti et al. | 420/420 |

FOREIGN PATENT DOCUMENTS

| | | | |
|---|---|---|---|
| 0045719 | 11/1972 | Japan | 420/418 |

OTHER PUBLICATIONS

Strychor et al., Met. Trans. 19A (Feb. 1988), 225.

D. Banerjee, A. K.; Gogia, T. K.; Nandi and V. A. Joshi; "A New Ordered Orthorombic Phase in a $Ti_3Al$-Nb Alloy", Aug. 10, 1987, Acta Metall., vol. 36, pp. 871-882, 1988.

*Primary Examiner*—Upendra Roy

*Attorney, Agent, or Firm*—James E. McGinness; James C. Davis, Jr.; James Magee, Jr.

[57] ABSTRACT

An improved titanium aluminide alloy contains from about 18 to 30 atomic percent aluminum, about 34 to 18 atomic percent niobium, with the balance titanium. In alloys of this invention a substatial portion of the microstructure, comprising at least about 50% of the volume fraction, is an orthorhombic phase.

25 Claims, 8 Drawing Sheets

TRI-TITANIUM ALUMINIDE ALLOYS CONTAINING AT LEAST EIGHTEEN ATOM PERCENT NIOBIUM

The U.S. Government has a paid-up license in this invention and the right in limited circumstances to require the patent owner to license others on reasonable terms as provided for by the terms of contract No. F33615-86-C-5073 awarded by the U.S. Air Force.

BACKGROUND OF THE INVENTION

This invention relates to titanium based alloys and more particularly to titanium aluminide alloys having high strength at elevated temperatures. Alloys of this invention also have sufficient room temperature ductility and fracture toughness to make them useful as engineering materials.

Great technological interest can be found in a titanium aluminide compound containing three titanium atoms per aluminum atom because of its low density and high strength relative to iron or nickel based superalloys or conventional titanium alloys. In the titanium alloy art this compound is designated as $Ti_3Al$ and is hereafter referred to as trititanium aluminum. Currently, some of the mechanical properties of trititanium aluminum alloys limit their usefulness. Some of the limiting properties are low ductility at room temperature, very little resistance to fracture, and a lack of metallurgical stability at temperatures above 1200° F. Therefore to be used in place of iron or nickel based superalloys, trititanium aluminum alloys must be improved in their room temperature ductility, fracture toughness, and metallurgical stability above 1200° F.

Different operating temperatures in various parts of a gas turbine place increasing demands on the high temperature strength and stability of alloys used in the engines. For example parts in the turbine section may have to operate at temperatures up to 1600° F. while parts in the compressor may operate at 1400° F. with still lower operating temperatures for parts like casings and flow augmentors. Trititanium aluminum alloys that are currently known exhibit a combination of mechanical properties that would make them useful as engineering materials capable of operating at temperatures up to about 1110° F. in lower stressed stationary applications. Therefore, by improving the high temperature strength and stability of trititanium aluminide alloys they can be utilized in more parts of a gas turbine.

The microstructure of titanium alloys and the way they change with a change in composition is well known in the art. When aluminum is added to titanium alloys the crystal form of the titanium alloys change. Small percentages of aluminum go into solid solution in titanium and the crystal form remains that of pure titanium, which is the close packed hexagonal alpha phase. Higher concentrations of aluminum, about 25 to 35%, form the intermetallic compound trititanium aluminum with an ordered hexagonal crystal form called alpha-2. Trititanium aluminum is the material of concern in this application because the titanium aluminum alloys of this invention are an improvement upon prior art trititanium aluminum alloys. Furthermore, the titanium aluminum alloys of this invention have a crystal form that is different from the crystal form of prior art trititanium aluminum alloys.

In pure titanium the alpha phase transforms at approximately 1615° F. to a body centered cubic beta phase. This temperature at which the low temperature alpha phase transforms to the high temperature beta phase is known as the transformation temperature. Certain elements known as alpha stabilizers, stabilize the alpha phase so that the transformation temperature for such alloys is increased above 1615° F. Other elements, such as niobium, stabilize the two phase alpha plus beta region. In titanium alloys the transformation from alpha to beta phase does not occur at a single temperature but over a range of temperatures where both alpha and beta phases are stable. As a result, in titanium aluminide alloys addition of beta phase stabilizers can promote a duplex phase structure of beta phase mixed with alpha or alpha-2 phase depending on the aluminum content.

Limited additions of niobium and other beta phase stabilizers such as molybdenum and vanadium have been shown to improve the room temperature ductility and creep strength of trititanium aluminum alloys, but those improvements have been accompanied by a loss in high temperature strength. Much of the research into titanium aluminides has been for their application in gas turbines. A combination of properties that are desirable in titanium aluminides for gas turbines are high strength and ductility at elevated as well as room temperature, fracture toughness, high modulus of elasticity, creep strength, and forgeability. Therefore, a balance of many properties is needed in a material to be used in gas turbines. However, an undesirable compromise between strength and ductility is necessary when using prior art trititanium aluminum alloys.

Fracture toughness is a measure of resistance to extension of a crack and is measured in units of ksi times square root inch, sometimes abbreviated as ksi·$\sqrt{\text{in}}$. The fracture toughness of prior art trititanium aluminum alloys is within the range of 10 to 20 ksi times square root inch. The fracture toughness of prior art trititanium aluminum alloys is well below the 50 to 60 ksi times square root inch fracture toughness of superalloys currently used in the rotating components of gas turbines. Therefore a significant increase in the fracture toughness of trititanium aluminum alloys would be highly desirable to meet the demanding requirements of rotating components in gas turbines.

In U.S. Pat. No. 3,411,901 to Winter it has been shown that titanium aluminide alloys near the composition, in atomic percent, 26.6% aluminum, 9% niobium, 0.8% silicon, with the balance titanium have an optimum combination of ductility and strength. Winter also teaches that when aluminum and niobium content were increased above this optimum composition hardness and strength were found to decrease. Alloys are sometimes hereafter abbreviated by showing, for example, this alloy as Ti-26.6Al-9Nb-0.8Si. All alloy compositions shown herein are in terms of atomic percent.

In the U.S. Pat. No. 4,292,077 to Blackburn et al. it was shown that some mechanical properties were optimized in a trititanium aluminum alloy containing 25 to 27 percent aluminum and 12 to 16 percent niobium. Increasing the niobium content above 16 percent is shown by Blackburn to be undesirable because very little improvement in creep strength was found above that level. Because density is increased when niobium is increased in trititanium aluminide alloys, increasing the niobium above 16 percent produced disadvantageous creep strength-to-density ratios. An industry recognized trititanium aluminum alloy that may be viable for the fabrication of gas turbine components having low fracture toughness requirements is derived from the Blackburn et al. alloy and has the composition Ti-24Al-11Nb.

U.S. Pat. No. 4,716,020 to Blackburn et al. is an improvement upon the '077 patent and discloses the same alloy but with a 0.5 to 4 percent molybdenum addition and a slightly lower niobium addition of 7 to 15.5 percent. Vanadium additions of 0.5 to 3.5 percent can be made to displace part of the niobium. An industry recognized reference alloy from this composition is Ti-25Al-10Nb-3V-1Mo. The teaching from the '020 patent is that molybdenum is a particularly unique addition that improves the high temperature strength and creep strength of the essential Ti-Nb-Al alloy of the '077 patent. However, the increased strength of the Ti-Al-Nb-V-Mo alloy is accompanied by an undesirable reduction in the alloys resistance to fracture at room temperature relative to the Ti-24Al-11Nb alloy.

Both Winter and Blackburn et al. found limited niobium additions of up to 16 atomic percent optimize the properties of aluminum alloys. Blackburn et al. then made improvements in the high temperature strength and creep rupture properties of Ti-Al-Nb alloys in the '020 patent, not through modification of the niobium content, but through the addition of molybdenum.

Contrary to the findings of Winter and Blackburn et al. we have found that high temperature strength and fracture toughness of titanium aluminide alloys are improved beyond the levels of these prior art alloys by increasing niobium contents substantially above 16 atomic percent.

The alloys of this invention contain titanium and aluminum contents typical of trititanium aluminum alloys and trititanium aluminum alloys are known to have the alpha-2 crystal form as their normal low temperature phase structure. Alloys of this invention also contain a substantially increased percentage of beta phase stabilizing niobium over the Winter and Blackburn et al. alloys. Since niobium is a beta phase stabilizer its presence in the trititanium aluminum alloys would be expected to preserve some beta phase in the low temperature alpha-2 phase of trititanium alloys. For example, the preferred microstructure of Blackburn et al. in their trititanium aluminum alloys containing niobium is a Widmanstatten structure characterized by an acicular alpha-2 phase mixed with beta phase lathes. Surprisingly the increase in niobium in the alloys of this invention substantially above 16 atomic percent did not lead to an increase in the amount of beta phase with a decrease in the amount of alpha-2 phase. Instead a new microstructure was discovered in the alloys of this invention having an ordered orthorhombic crystal form rather than the hexagonal alpha-2 or body centered cubic beta crystal forms that are known to be present in trititanium aluminum alloys. Beta, ordered beta or alpha-2 phase may be present in the alloys of this invention but an important contribution to the improved properties in the alloys of this invention is believed to be due to the presence of the orthorhombic phase. The ordered orthorhombic phase is believed to form the intermetallic compound $Ti_2AlNb$.

Therefore, it is an object of this invention to provide titanium aluminide alloys containing a substantial portion of an orthorhombic crystal form comprising at least 25% of the volume fraction of their microstructure.

Another object of this invention is to provide titanium aluminide alloys containing niobium additions substantially above 16 atomic percent and having superior tensile strength at elevated temperatures up to 1500° F. while retaining sufficient ductility at room temperature and good fracture toughness so they can form useful engineering materials.

BRIEF SUMMARY OF THE INVENTION

These and other objects are achieved by providing a titanium based alloy containing, by atomic percent, about 18 to 30 percent aluminum, and about 18 to 34 percent niobium with the balance essentially titanium. The term "balance essentially titanium" means titanium is the predominant element being greater in content than any other element present in the alloy and comprises the remaining atomic percentage. However, other elements which do not interfere with achievement of the strength, ductility and fracture toughness of the alloy may be present either as impurities or at non-interfering levels. Impurity amounts of oxygen, carbon and nitrogen, should be less than 0.6 atomic percent each, and tungsten should be less than 1.5 atomic percent.

The alloy containing about 18 to 30 percent aluminum, about 18 to 34 percent niobium with the balance essentially titanium has a high yield strength at temperatures up to at least 1500° F. and good fracture toughness. The term "high yield strength" as used herein means the alloy has a yield strength at least as high as the yield strength of prior art trititanium aluminum alloys, although the high yield strength of prior art trititanium aluminum alloys is only achieved at temperatures up to about 1110° F. The term "good fracture toughness" as used herein means the alloy has a fracture toughness at least comparable to the 10 to 20 ksi times square root inch fracture toughness of prior art trititanium aluminum alloys.

A more preferred alloy of the present invention contains about 18 to 25.5 percent aluminum, about 20 to 34 percent niobium with the balance essentially titanium, and has a high yield strength at temperatures up to at least 1500° F. and superior fracture toughness. The term "superior fracture toughness" as used herein means the alloy has a fracture toughness at least as high and higher than the 10 to 20 ksi times square root inch fracture toughness of prior art trititanium aluminum alloys.

Another preferred alloy of the present invention contains about 23 to 30 percent aluminum, about 18 to 28 percent niobium with the balance essentially titanium, and has superior yield strength at temperatures up to at least 1500° F. and good fracture toughness. The term "superior yield strength" as used herein means that the alloy has a yield strength at least as high and higher than the yield strength of prior art trititanium aluminum alloys.

Another preferred alloy of the present invention contains about 21 to 26 percent aluminum, about 19.5 to 28 percent niobium with the balance essentially titanium; and has a superior combination of fracture toughness, and high yield strength at temperatures up to at least 1500° F. The term "superior combination of fracture toughness and high yield strength" as used herein means the alloy has a combination of fracture toughness and yield strength that is at least as high and higher than prior art trititanium aluminum alloys.

Surprisingly, I have found that a niobium content of about 18 to 34 percent in the titanium aluminum alloys of this invention provides increased elevated temperature strength. The increase in strength is achieved without loss of room temperature ductility, and with an increase in fracture toughness over prior art trititanium aluminum alloys containing niobium. In alloys of this invention the ratio of yield strength to density is significantly increased up to about 50% or more over prior art trititanium aluminum alloys containing niobium.

BRIEF DESCRIPTION OF THE DRAWINGS

The description which follows will be understood with greater clarity if reference is made to the accompanying drawings in which.

DETAILED DESCRIPTION OF THE INVENTION

Figure 1:
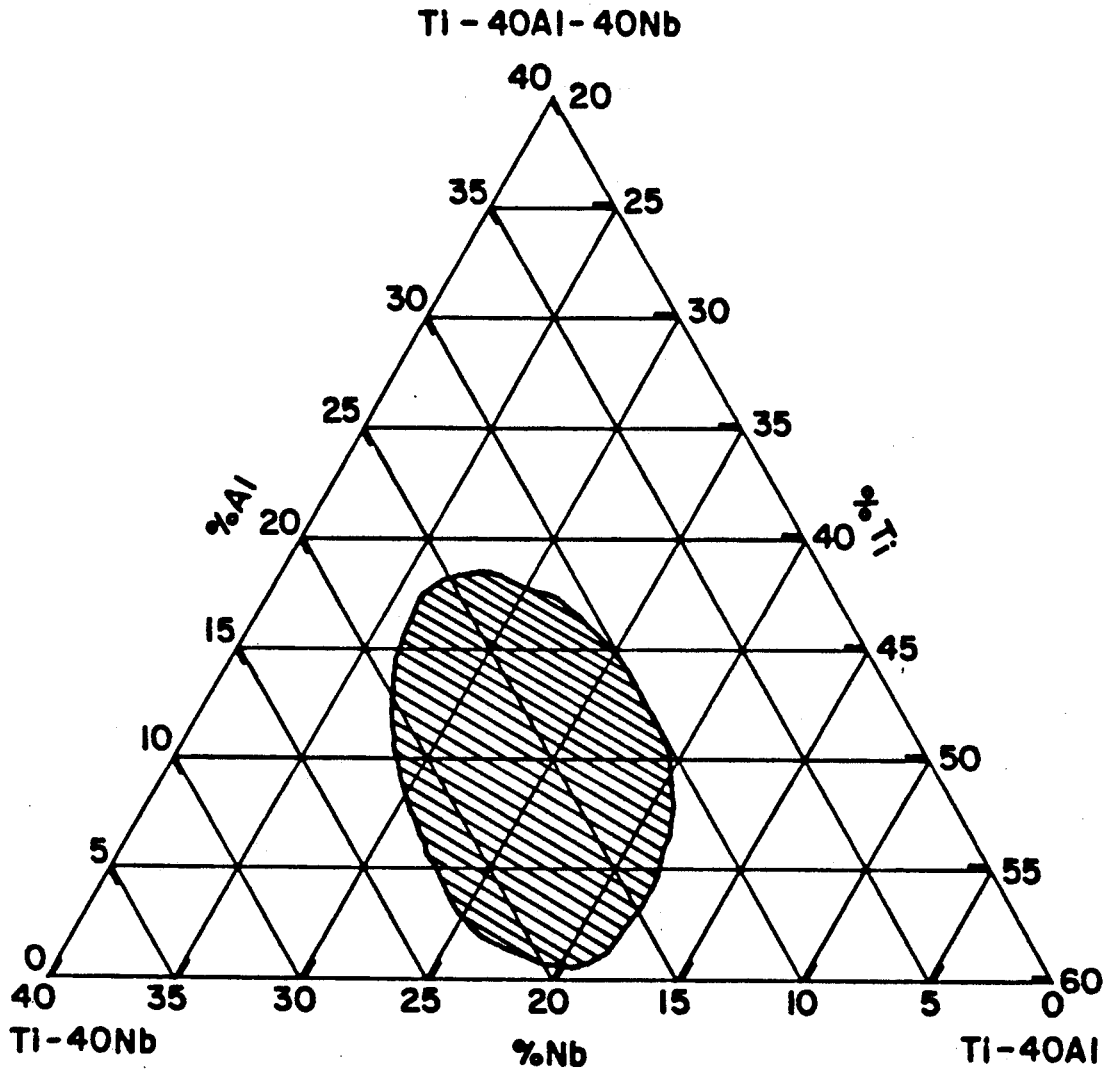
FIG. 1 is a triaxial plot of the concentrations of titanium, aluminum, and niobium in compositions of the alloys of this invention.
Figure 2:
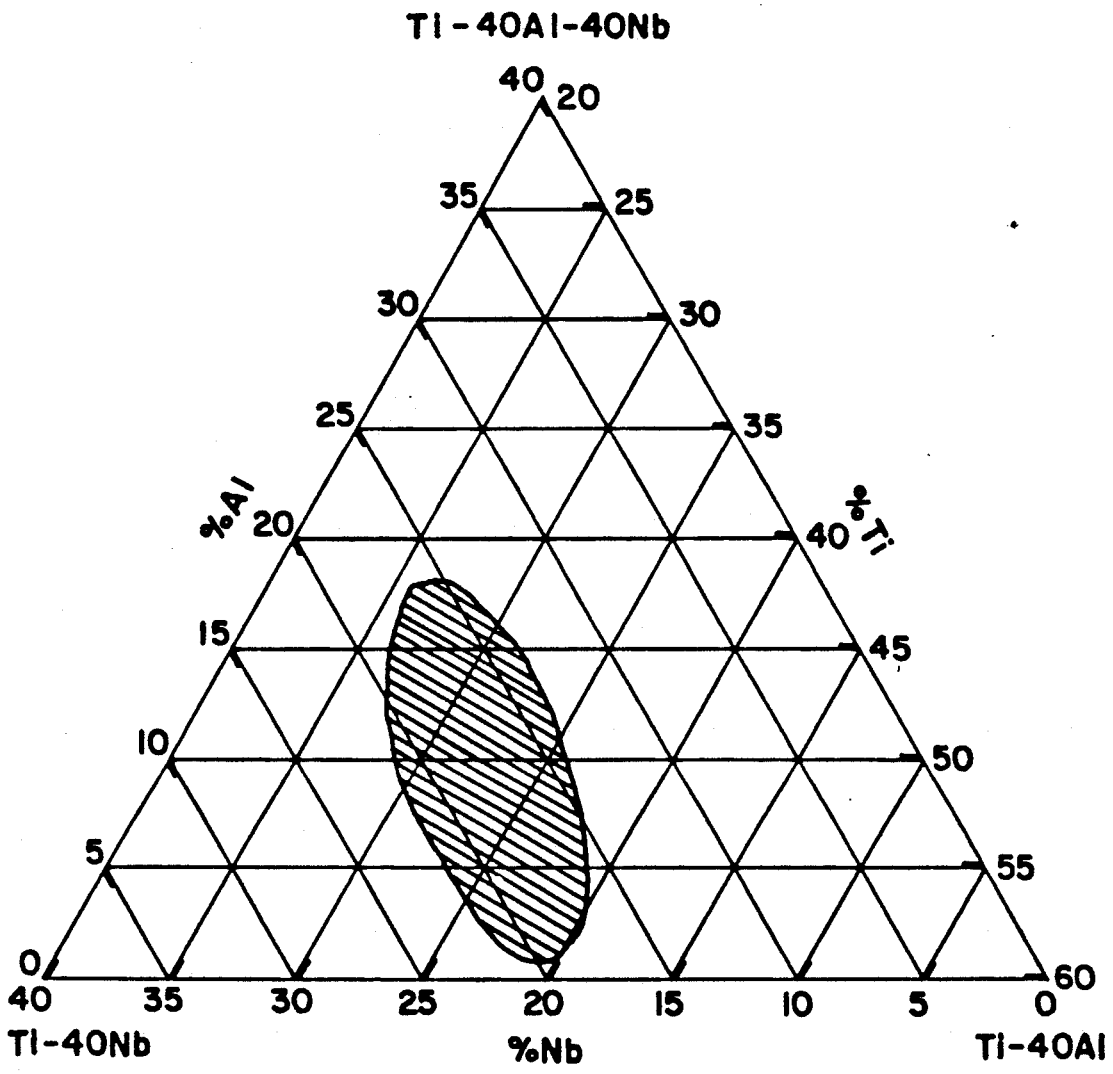
FIG. 2 is a triaxial plot of the concentrations of titanium, aluminum, and niobium in compositions of alloys of this invention that specifically improve fracture toughness.
Figure 3:
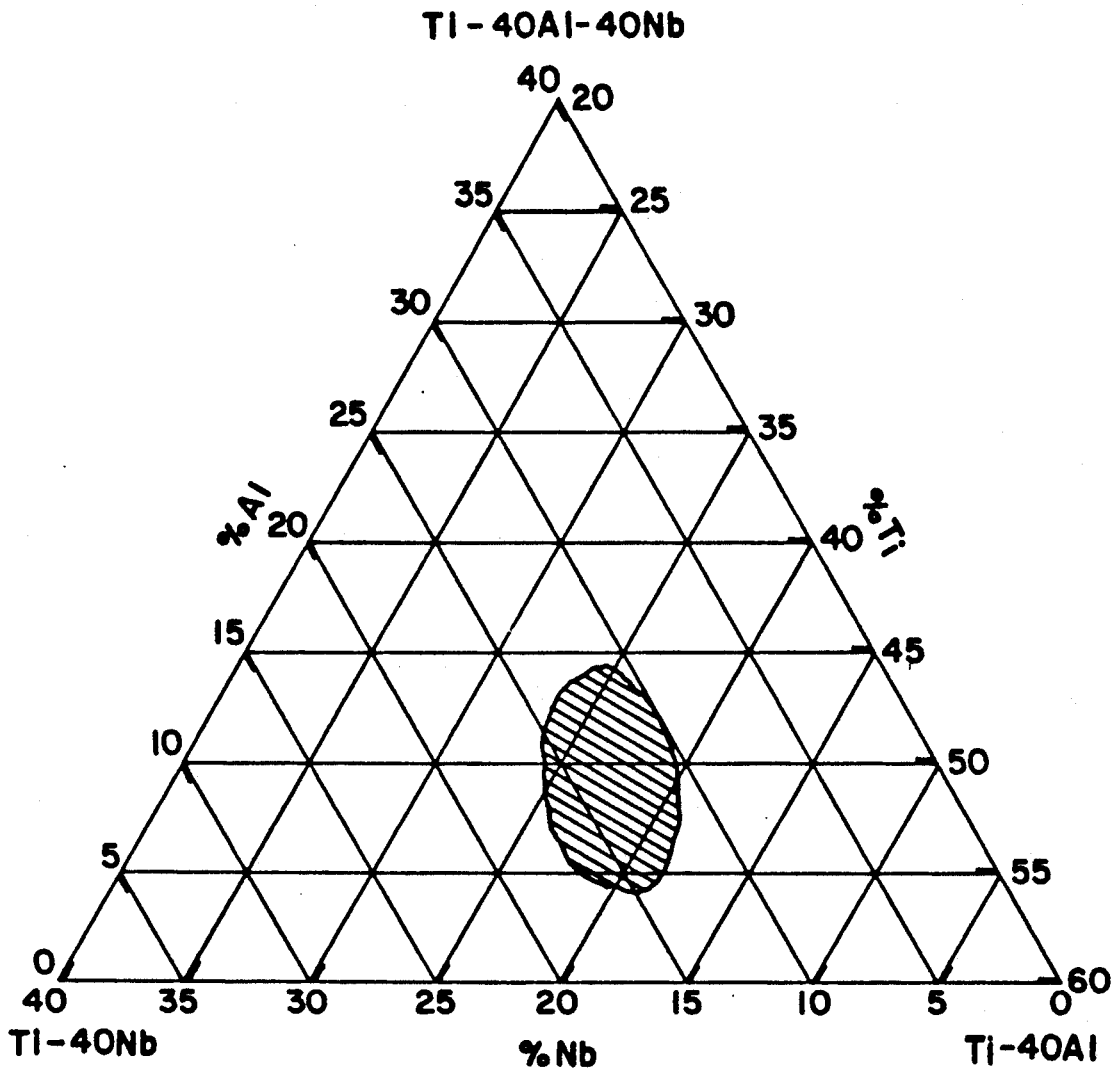
FIG. 3 is a triaxial plot of the concentrations of titanium, aluminum, and niobium in compositions of alloys of this invention that specifically improve yield strength.
Figure 4:
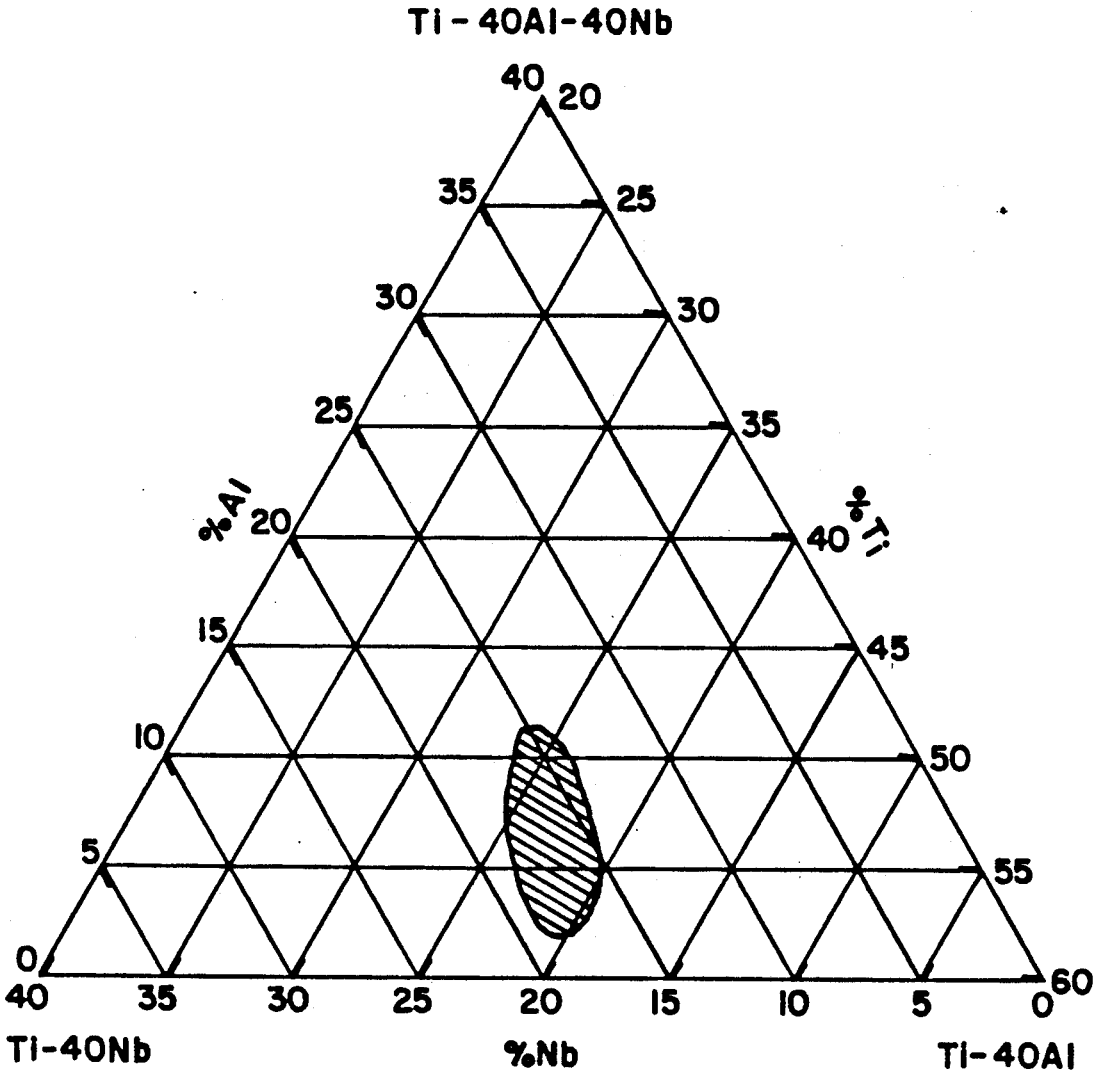
FIG. 4 is a triaxial plot of the concentrations of titanium, aluminum, and niobium in compositions of alloys of this invention that improve fracture toughness and yield strength.

Titanium aluminum alloys of this invention attain superior yield strengths up to 110 ksi or greater at elevated temperatures up to 1500° F. and higher. Room temperature ductility and good fracture toughness are maintained so that the alloys may form useful engineering materials. Alloys of the invention are illustrated in FIGS. 1–4 and correspond approximately to the atomic percentages of titanium, aluminum, and niobium in the hatched area in the triaxial plots of FIGS. 1–4. For the benefit of searchers in this art alloys of this invention can be described by referring to the outer limits of the hatched area in the triaxial plot of FIG. 1. Alloys illustrated by the hatched areas in the triaxial plots of FIGS. 2–4 are within the hatched area of the triaxial plot of FIG. 1. The outer limits of the triaxial plot in FIG. 1 are about 18 to 30% aluminum, about 18 to 34% niobium, with the balance comprising essentially titanium. However, the compositions are claimed based on the alloy content as depicted in FIGS. 1–4.

Fracture toughness of the alloys of this invention is particularly improved by compositions that correspond approximately to the hatched area in the triaxial plot of FIG. 2. Yield strength is particularly improved by compositions that correspond approximately to the hatched area in the triaxial plot of FIG. 3. Both yield strength and fracture toughness are improved by compositions that correspond approximately to the hatched area in the triaxial plot of FIG. 4.

EXAMPLES

Table I below lists the compositions of a series of titanium aluminide alloys that were prepared.

TABLE I

ALLOY COMPOSITIONS

| Sample Number | Alloy Number | Composition, Atomic Percent AL | Nb | Ti | Other Additions |
|---|---|---|---|---|---|
| 1 | 529 | 23.3 | 24 | Balance | |
| 2 | 619 | 24.7 | 29.7 | " | |
| 3 | 629 | 28.5 | 24.1 | " | |
| 4 | 649 | 21.9 | 26.8 | " | |
| 5 | 662 | 32.7 | 26.3 | " | |
| 6 | 712 | 25.9 | 23.9 | " | |
| 7 | 713 | 25.3 | 21.0 | " | |
| 8 | 714 | 21.7 | 25.3 | " | |
| 9 | 715 | 21.7 | 22.3 | " | |
| 10 | 550 | 19.1 | 20.2 | " | |
| 11 | 551 | 19.7 | 29.9 | " | |
| 12 | 914 | 21.4 | 29.3 | " | |
| 13 | 921 | 28.5 | 27.9 | " | |
| 14 | 922 | 27.6 | 33.4 | " | |
| 15 | 923 | 27.4 | 23.6 | " | |
| 16 | 924 | 30.1 | 28.7 | " | |
| 17 | 907 | 25.0 | 26.0 | " | |
| 18 | 989 | 24.5 | 10.2 | " | 0.16 Si |
| 19 | 996 | 23.5 | 10.7 | " | 0.04 Y |

In Table I samples 1–17 have compositions formulated to determine the scope of the alloys of this invention. Sample numbers 18 and 19 were prepared as reference alloys from the composition of Blackburn et al. in U.S. Pat. No. 4,292,077. Alloys having sample numbers 1–11 were non-consumable arc melted and rapidly solidified as ribbons by melt spinning. The ribbons were consolidated into cylinders by hot isostatic pressure compaction at 1785° F. Hot die forging at 1830° F. was performed to reduce the cylinders in their height dimension about 6:1 into discs. Sample numbers 12–17 were non-consummable arc melted into flat buttons and hot die forged to reduce the buttons about 3:1 at 1830° F. into discs.

Rectangular blanks were machined from the forged discs and encapsulated in titanium tubes inside gettered argon-filled quartz tubes for heat treatment. A gettered tube contains yttrium as a getter. Since yttrium has a higher affinity for oxygen and nitrogen, it minimizes contamination of the titanium blanks from any residual oxygen and nitrogen in the argon purged tubes.

The blanks were given a two stage anneal. The first stage anneal was at a temperature just above the beta transus. The beta transus is the temperature at which the microstructure of titanium or titanium alloys transforms from the low temperature alpha or alpha-2 phase to the high temperature beta phase. Beta transus temperatures vary depending upon the composition of titanium alloys. Therefore depending upon the composition of the sample prepared from example alloys 1–17, the first stage anneal was performed at a temperature just above the beta transus temperature for that composition. First stage anneals above the beta transus ranged from 2050° F. to 2280° F. for 1 to 2 hours. Some blanks were given a first stage anneal below the beta transus at 1830° F. to produce a finer grain size. The second stage anneal was at 1600° F. for 2 to 4 hours.

The specific annealing time and temperature used for each blank is shown in Tables II–VIII below. The annealed blanks were then machined into 3×4×25 mm bars for three-point bend testing, small coupons for Vickers hardness testing, and 25×2.5×2.5 mm notched bars for fracture toughness testing. A set of 1.5×3×25 mm bars were also machined from the blanks of alloy 907 for four point bend testing.

The prior art reference alloys were prepared by purchasing ingots having the compositions shown as sample number 18 and 19 in Table I. The ingots were processed into plates 5×55×220 mm using forging and rolling parameters known to optimize the mechanical properties of these alloys. The plates were heat treated at 2125° F. for 1 hour, fan quenched and reheated to 1400° F. for 1 hour followed by furnace cooling. Blanks were secured from the heat treated plates by electrode discharge machining. Flat tensile specimens were milled from the blanks to have a gage width of 0.08 inch, a gage length of 0.25 inch and a thickness of 0.06 inch. Small coupons were machined from the blanks for Vickers hardness testing. Three point bend testing bars 3×4×25 mm were also machined from the blanks.

Two methods were used to compare the high temperature strength of blanks prepared from sample alloys of this invention to blanks prepared from the prior art reference alloys. The first method was to determine the Vicker's diamond pyramidal hardness (VHN) of the small coupon sized blanks at temperatures from room temperature to 1830° F. The second method was to perform bend tests from room temperature to 1700° F. on the bars machined to size for bend testing.

Vickers hardness was determined because indentation hardness has been shown to be an indicator of the yield strength of materials by W. Hirst and M. G. J. W. Howse in "The Indentation of materials by Wedges, Proceedings of the Royal Society A.", V. 311, pp. 429-444 (1969). Also S. S. Chiang, D. B. Marshall, and A. G. Evans in "The Response of Solids to Elastic/-Plastic Indentation, I. Stresses and Residual Stresses", Journal of Applied Physics, V. 53, pp. 298-311, (1982) show experimental data supporting the relation between indentation hardness and yield strength.

To determine the relation between indentation hardness and yield strength, Vickers diamond pyramidal hardness tests and tensile tests were performed on the blanks prepared from the composition of sample 18. Sample 18 is one of the prior art reference alloys identified as alloy 989 in Table I. The tensile tests and Vickers hardness tests were performed over a range of temperatures from 72° F. up to 1500° F. The tensile test results are shown below in Table II and the Vickers hardness test results are in Table III.

TABLE II

Tensile Yield Strength vs. Temperature
For Ti—24Al—11Nb atomic percent Heat treated at 2120° F. 1 hr. + 1400° F. 1 hr.

| TEMPERATURE (T) (°F.) | YIELD STRENGTH (Y) (ksi) |
|---|---|
| 72 | 97.8 |
| 570 | 84.8 |
| 930 | 78.1 |
| 1110 | 75.5 |
| 1290 | 61.1 |
| 1470 | 52.5 |

TABLE III

Vickers Hardness Number vs. Temperature
for alloy 989 (Ti—24Al—11Nb atomic percent),
Heat treated for 2120° F. 1 hr. + 1400 F. 1 hr.

| Temperature (°F.) | VHN |
|---|---|
| 72 | 316 |
| 570 | 253 |
| 800 | 259 |
| 900 | 240 |
| 1000 | 239 |
| 1100 | 238 |
| 1200 | 222 |
| 1300 | 207 |
| 1400 | 196 |
| 1500 | 173 |

Vickers hardness tests were conducted on the coupons prepared from alloy 989 using a pyramidal diamond indentor with a 1000 gram indentation load. The tensile yield strength tests were performed on an INSTRON tensile machine using strain rates recommended in ASTM specification E8 "Standard Methods of Tension Testing of Metallic Materials," Annual Book of ASTM Standards Vol. 03.01, pp 130-150, 1984.

Figure 5:
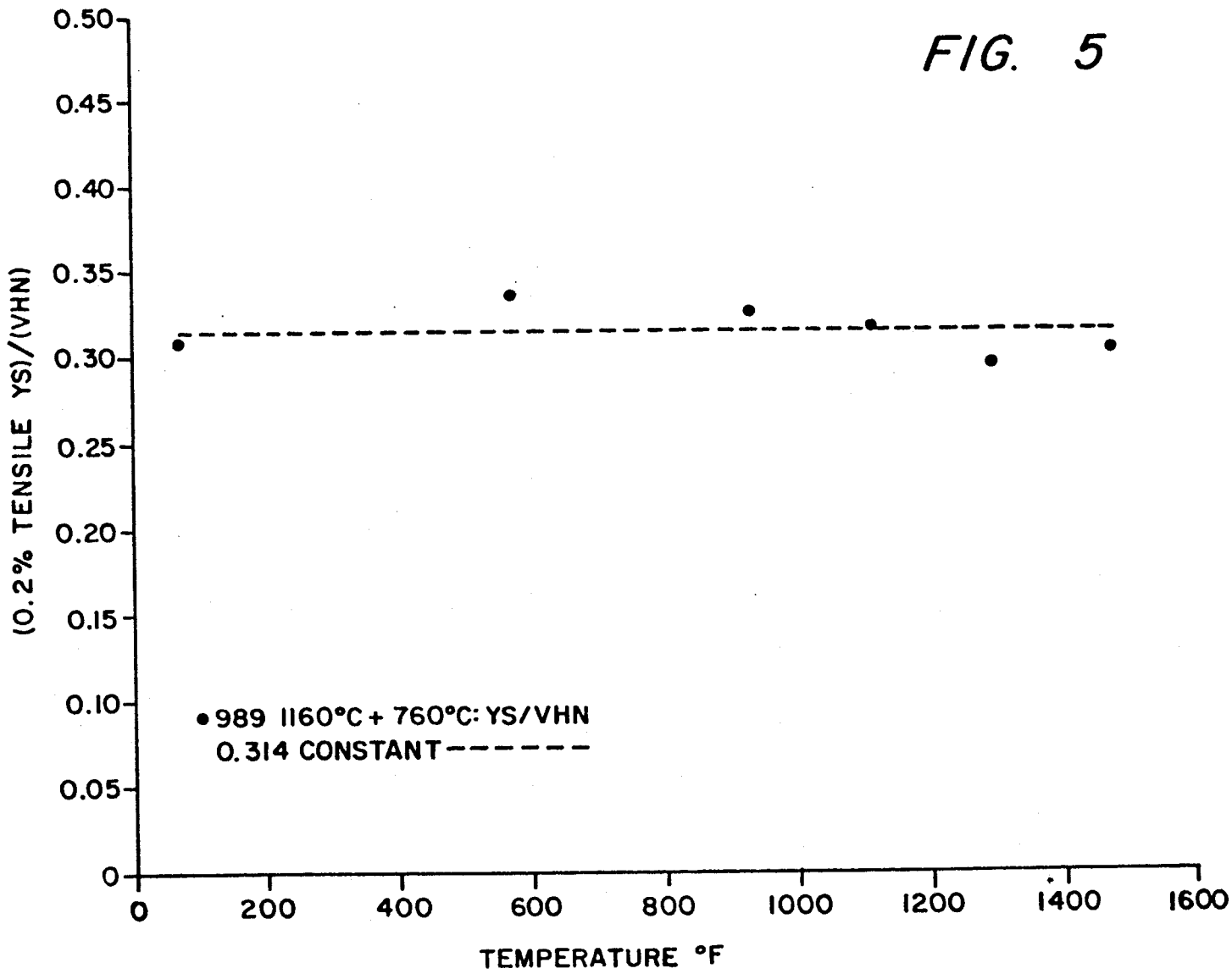
FIG. 5 is a graph of the ratio of the 0.2% tensile yield strength to the Vickers hardness of reference sample alloy 989 from room temperature to 1470° F.

In the graph of FIG. 5 a plot of the ratio of the tensile yield strength to the Vickers hardness number, as plotted on the ordinate, for the temperature range tested, as plotted on the abscissa, is shown. The graph of FIG. 5 demonstrates the linear relationship between the tensile yield strength and the Vickers hardness number in trititanium aluminum alloys. This linear relationship can be described as the tensile yield strength being equal to the constant 0.314 multiplied by the Vickers hardness number. In an equation form where Y is the yield strength and VHN is the vickers hardness number the linear relationship between tensile yield strength and Vickers hardness is $Y=0.314\times VHN$.

Figure 6:
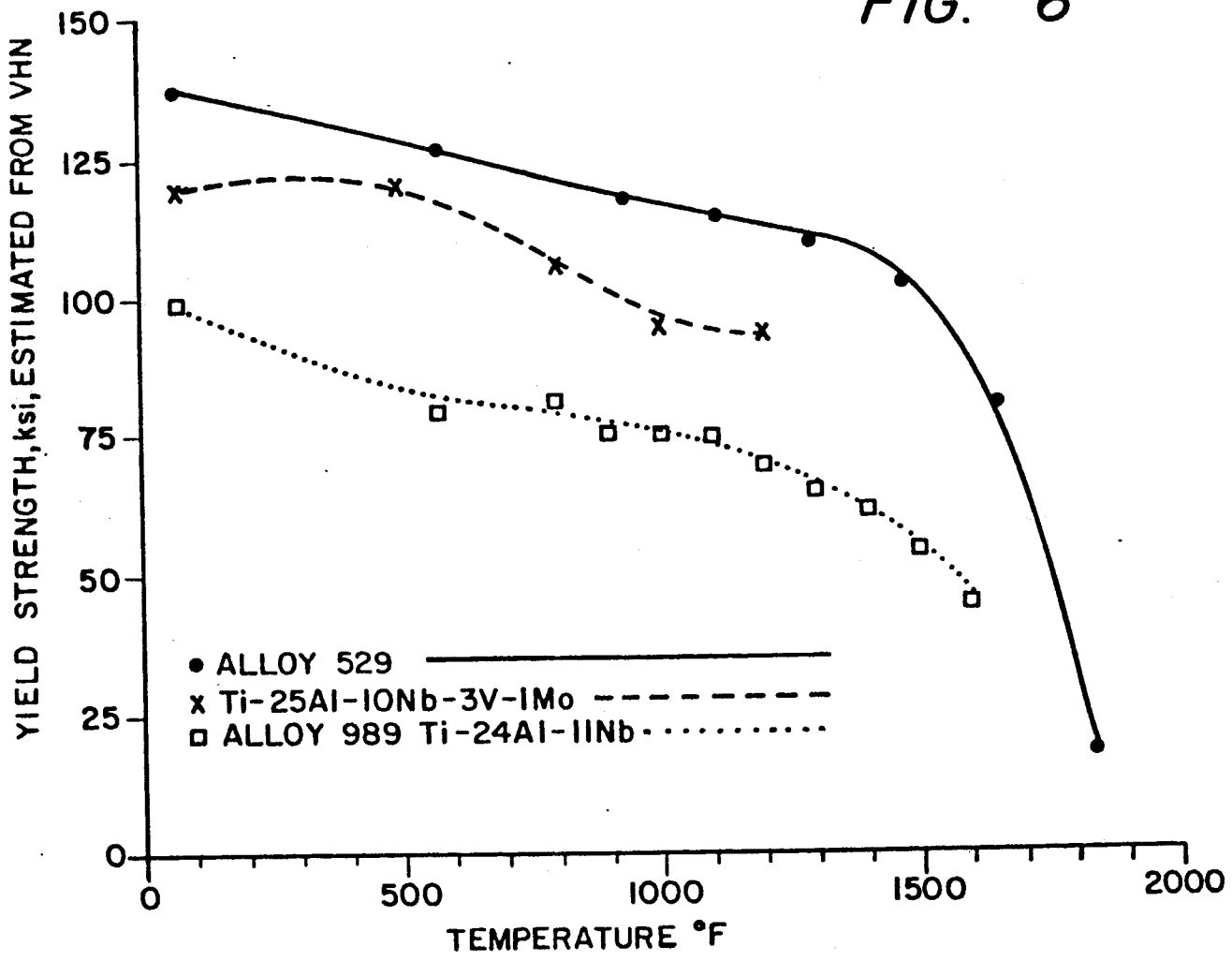
FIG. 6 is a graph comparing the estimated yield strength of sample alloy 529 to reference sample alloy 989 from room temperature to 1600° F.

Vickers hardness from room temperature to 1830° F. was then measured on the blanks prepared from alloy 529 in Table I. The yield strength was determined by using the same constant of proportionality, 0.314, that was developed from alloy 989. In this way the yield strength of alloy 529 and the reference alloy 989 could be compared from room temperature to over 1500° F. based on the Vickers hardness testing. This comparison is shown in FIG. 6. The yield strength of the Ti-25Al-10Nb-3V-1Mo alloy at elevated temperatures, as disclosed in Table 1 column 3 of the Blackburn et al. '020 patent, is also shown in FIG. 6 for comparison. It is apparent from this comparison in FIG. 6 that the alloys of this invention provide improved low and high temperature strength over prior art trititanium aluminum alloys containing niobium and even over improved trititanium aluminum alloys containing niobium, vanadium and molybdenum.

The second method used to evaluate the high temperature strength of the alloys of this invention was three point bend testing. Three point bend bar specimens processed as described above for sample numbers 2, 3, and 5 were tested in vacuum at temperatures from 1200° F. to 1800° F. Three point bend tests were performed in conformance with Department of the Army standard MIL-STD-1942A (Proposed): "Flexural Strength of High Performance Ceramics at Ambient Temperatures". Four-point bend tests were performed on the blanks prepared from sample 17 in accordance with the Army standard referenced above. The 0.2% outer fiber yield strength and an estimate of the outer fiber strain at failure were determined. The 0.2% outer fiber yield strength is the stress where the outer fiber plastic strain is 0.2%. The outer fiber strain is a measurement of ductility and is the amount of plastic deformation experienced at the outer fiber surface of the bending specimen at the time of fracture. The maximum strain that could be achieved was about 5 to 6% because of restrictions in the amount of bending before interference with the bar mount occurred.

Figure 7:
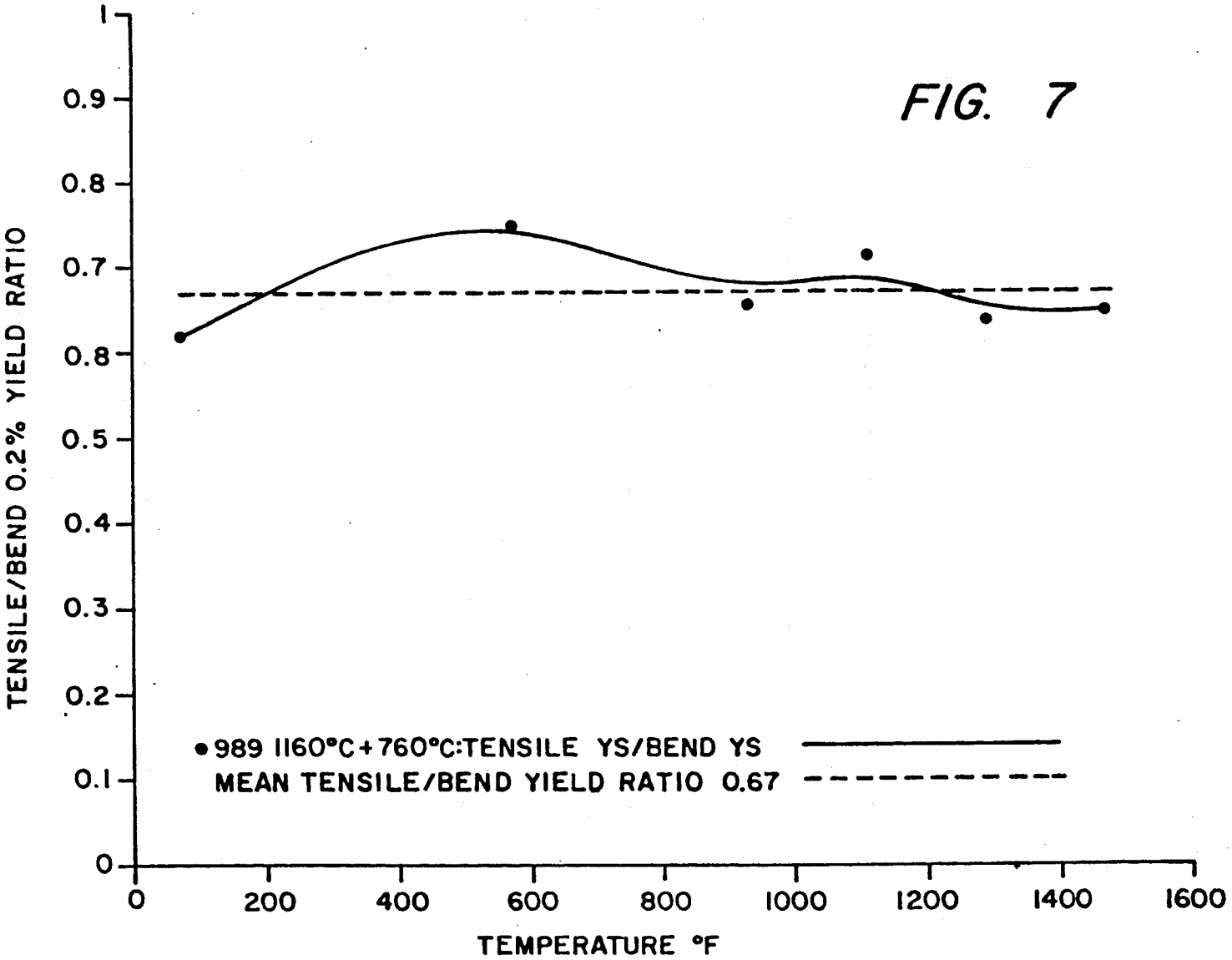
FIG. 7 is a graph of the ratio of the 0.2% tensile yield strength in reference sample alloy 989, to the 0.2% bend yield stress of reference sample alloy 989 from room temperature to 1470° F.

Calibration of the bend tests was accomplished by bend testing the bars prepared from the prior art reference alloy 989 and comparing these results to the uniaxial tension tests performed on alloy 989 and shown in Table II. The ratio of the 0.2% tensile yield stress, $Y_T$, to the 0.2% bend yield stress, $Y_B$, is plotted as a function of temperature in FIG. 7. A good fit of this experimental data was found in the linear relationship $Y_T=0.67\times Y_B$.

The bend test results from the blanks prepared from the compositions of samples 2, 3, 5 and 17 in Table I are shown below in Tables IV and V. The tensile yield strength was calculated for each bend test shown in Tables IV and V by using the linear relationship established above where $Y_T=0.67\times Y_B$.

Table IV contains yield strength test results from blanks heat treated above the beta transus temperature while Table V contains the test results for samples heat treated below the beta transus. By comparing Tables IV and V it can be seen that the yield strength of the alloys of this invention is generally improved by heat treating above the beta transus temperature. By comparing Tables IV and II it can be seen that the tensile yield strength of the alloys of this invention is improved by as much as 200% over prior art Trititanium aluminum alloys containing niobium.

The microstructure of the alloys of this invention was investigated using standard metallographic techniques. Metallographic specimens from the blanks prepared from samples numbered 5–11 in Table I were heat treated at temperatures ranging from 1800° F. to 2190° F. for about 2 hours to determine the range of temperatures at which the alloys of this invention transform from low temperature phases to high temperature phases such as the beta phase. These specimens from sample numbers 5–11 were also heat treated at these temperatures to determine what microstructures develop when alloys of this invention are heated above their phase transformation temperature and subsequently cooled.

TABLE IV

Bend Yield Strength ($Y_B$) and Estimated Yield Strength ($Y_T$) of alloys having compositions near that of Ti—25Al—25Nb and heat treated above the beta transus temperature

| TEST NO | ALLOY NO. | TEST TEMP (T) °F. | OUTER FIBER STRAIN (%) | BEND YS ($Y_b$) | EST TENSILE YS ($Y_T$) | HEAT TREATMENT °F. |
|---|---|---|---|---|---|---|
| 1 | 907 | RT | 0.39 | 149.0 | 100 | 2280/1 hr. |
| 2 | 907 | RT | 0.6 | 149.0 | 100 | 2010/1 hr. |
| 3 | 907 | RT | 0.6 | 146.0 | 98 | 2010/1 hr. |
| 4 | 619 | 1400 | 0.13 | 186.0* | 125* | 2280/1 hr. + 1600/2 hr. |
| 5 | 619 | 1400 | 0 | 199.0* | 133* | 2280/1 hr. + 1600/2 hr. |
| 6 | 619 | 1500 | 0.73 | 137.0 | 92 | 2280/1 hr. + 1600/2 hr. |
| 7 | 619 | 1600 | >3.2 | 53.0 | 36 | 2280/1 hr. + 1600/2 hr. |
| 8 | 619 | 1600 | 0.71 | 113.0 | 76 | 2280/1 hr. + 1600/2 hr. |
| 9 | 619 | 1700 | >5.95 | 50.0 | 34 | 2280/1 hr. + 1600/2 hr. |
| 10 | 619 | 1800 | >5.95 | 19.0 | 13 | 2280/1 hr. + 1600/2 hr. |
| 11 | 629 | 1300 | 2.5 | 209.0 | 140 | 2190/1 hr. + 1600/4 hr. |
| 12 | 629 | 1400 | 1.06 | 177.0 | 119 | 2190/1 hr. + 1600/4 hr. |
| 13 | 629 | 1500 | 1.48 | 164.0 | 110 | 2190/1 hr. + 1600/4 hr. |
| 14 | 629 | 1600 | 4.8 | 96.0 | 64 | 2190/1 hr. + 1600/4 hr. |
| 15 | 629 | 1700 | >5.4 | 68.0 | 46 | 2190/1 hr. + 1600/4 hr. |
| 16 | 649 | 1200 | 1.07 | 194.0 | 130 | 2055/1 hr. + 1600/4 hr. |
| 17 | 649 | 1300 | 0.97 | 169.0 | 113 | 2055/1 hr. + 1600/4 hr. |
| 18 | 649 | 1400 | 1.17 | 131.0 | 88 | 2055/1 hr. + 1600/4 hr. |
| 19 | 649 | 1500 | 3.32 | 82.0 | 55 | 2055/1 hr. + 1600/4 hr. |
| 20 | 649 | 1600 | >5.3 | 42.0 | 28 | 2055/1 hr. + 1600/4 hr. |
| 21 | 662 | 1600 | 0 | 68.0* | 46* | 2010/1 Hr. + 1600/4 hr. |

*0.2% plastic strain not achieved, YS taken as failure stress.

TABLE V

Bend Yield Strength ($Y_B$) and Estimated Yield Strength ($Y_T$) of alloys having compositions near that of Ti—25Al—25Nb and heat treated below the beta transus temperature

| TEST NO | ALLOY NO. | TEST TEMP (T) °F. | OUTER FIBER STRAIN (%) | BEND YS ($Y_b$) | EST TENSILE YS ($Y_T$) | HEAT TREATMENT °F. |
|---|---|---|---|---|---|---|
| 22 | 619 | 1300 | >4.05 | 165.0 | 111 | 1832/2 hr. + 1600/2 hr. |
| 23 | 619 | 1400 | >3.8 | 145.0 | 97 | 1832/2 hr. + 1600/2 hr. |
| 24 | 619 | 1500 | >4.09 | 72.0 | 48 | 1832/2 hr. + 1600/2 hr. |
| 25 | 619 | 1600 | >5.4 | 37.0 | 25 | 1832/2 hr. + 1600/2 hr. |
| 26 | 619 | 1700 | >5.9 | 13.0 | 9 | 1832/2 hr. + 1600/2 hr. |
| 27 | 629 | 1200 | 0 | 107.0* | 72* | 1832/1 hr. + 1600/4 hr. |
| 28 | 629 | 1600 | 2.1 | 61.0 | 41 | 1832/1 hr. + 1600/4 hr. |
| 29 | 629 | 1700 | >4.6 | 28.0 | 19 | 1832/1 hr. + 1600/4 hr. |

*0.2% plastic strain not achieved, YS taken as failure stress.

Microstructures developed by such heating and cooling are called transformation microstructures.

Specimens from the blanks prepared from samples numbered 1–4 and 12–17 in Table I were heat treated at temperatures ranging from 1200° F. to 2000° F. for time periods ranging from 70 to 100 hours. The specimens were heat treated for such extended time periods of 70 to 100 hours to determine the stability of the microstructure of the alloys of this invention.

The specimens from sample numbers 1–17 were then examined metallographically to determine what microstructural changes had occurred from the heat treatments. All samples were encapsulated during heat treatment to prevent oxygen contamination. Metallographic examination results are shown below in Table VI.

Metallographic examination of these specimens showed some of the microstructures remained stable or exhibited only slight recrystallization even after the long term annealing exposures performed on specimens from sample numbers 1–4 and 12–17. These stable microstructures are characterized in Table VI as the Type 1, 2 and 3 microstructures. Other alloys displayed precipitation of what appear to be eutectoid phases, grain boundary phases or very sharp needle-like phases, and are characterized in Table VI as Type 4 microstructures. Still another sample alloy exhibited parallel lamellar phases as well as Widmanstatten decomposition, and was characterized below as a Type 5 microstructure.

TABLE VI

MICROSTRUCTURE OF TRANSFORMATION ANNEALED SAMPLES

| Sample No. | Alloy No. | Microstructure | Distinguishing Mechanical Property |
|---|---|---|---|
| 2 | 619 | Type 1 | Highest |
| 4 | 649 | " | Fracture |
| 12 | 914 | " | Toughness |
| 8 | 714 | " | |
| 9 | 715 | " | |
| 11 | 551 | " | |
| 1 | 529 | Type 2 | Combination |
| 17 | 907 | " | of High |
| 6 | 712 | " | Fracture |
| 7 | 713 | " | Toughness and High Strength |
| 3 | 629 | Type 3 | Highest |
| 15 | 923 | " | Strength |
| 5 | 662 | Type 4 | |
| 13 | 921 | " | |
| 14 | 922 | " | |
| 16 | 924 | " | |
| 10 | 550 | Type 5 | |

Fracture toughness measurements were made on the notched bars prepared from sample numbers 1–5 and prior art sample alloy 19. Some samples were given an additional 100 hour heat treatment at temperatures from 1200° F. to 2000° F. as shown in Table VIII below. The tests were performed at room temperature by three-point bending in accordance with ASTM Standard E399-81, Standard Test Method for Plane-Strain Fracture Toughness of Metallic Materials, Annual Book of ASTM Standards, 1981, Part 10: Metals-Mechanical, Fracture and Corrosion Testing; Fatigue: Erosion and Wear; Effect of Temperature. American Society for Testing and Materials, 1981 Philadelphia, Pa., pp. 588–618. However, the bars were not fatigue precracked so the fracture toughness, designated as $K_Q$, is reported here as a relative value. This measurement permits estimates of fracture toughness for comparative ranking of alloys of this invention to the sample alloy 19 identified as alloy number 996 in Table I. Fracture toughness test results on the annealed bars are shown below in Table VII while results from bars given an extra 100 hour aging treatment are shown in Table VIII.

TABLE VII

Room Temperature Fracture Toughness $K_Q$ of Heat treated and Aged Samples

| ALLOY No. | $K_Q$ (ksi · $\sqrt{in}$) | HEAT TREATMENT °F. |
|---|---|---|
| 529 | 19.66 | 2010/1 hr. |
| 529 | 17.81 | 2010/1 hr. |
| 529 | 20.55 | 2010/1 hr. |
| 529 | 24.73 | 2280/1 hr. |
| 529 | 21.34 | 2280/1 hr. |
| 619 | 16.87 | 2280 1 hr. + 1600 2 hr. |
| 619 | 28.06 | 2280 1 hr. + 1600 2 hr. |
| 629 | 9.32 | 2190 1 hr. + 1600 4 hr. |
| 629 | 8.55 | 2190 1 hr. + 1600 4 hr. |
| 629 | 6.27 | 1832 2 hr. + 1600 2 hr. |
| 629 | 5.90 | 1832 2 hr. + 1600 2 hr. |
| 649 | 27.84 | 2055 1 hr. + 1600 4 hr. |
| 649 | 29.73 | 2055 1 hr + 1600 4 hr. |
| 662 | 2.88 | 2010 1 hr + 1600 4 hr. |
| 996 | 21.8 | 2125 1 hr + 1400 1 hr. |
| 996 | 16.0 | 2125 1 hr + 1400 1 hr. |
| 996 | 14.5 | 2125 1 hr + 1400 1 hr. |
| 996 | 16.2 | 2125 1 hr + 1400 1 hr. |
| 996 | 15.4 | 2125 1 hr + 1400 1 hr. |

TABLE VIII

Room Temperature Fracture Toughness, $K_Q$, of Heat treated and Aged Samples

| ALLOY No. | $K_Q$ (ksi · $\sqrt{in}$) | HEAT TREATMENT °F. |
|---|---|---|
| 619 | 21.47 | 2280 1 hr. + 1600 2 hr. + 1200/100 hr. |
| 619 | 28.52 | 2280 1 hr. + 1600 2 hr. + 1200/100 hr. |
| 619 | 22.66 | 2280 1 hr. + 1600 2 hr. + 1600/100 hr. |
| 619 | 16.72 | 2280 1 hr. + 1600 2 hr. + 1600/100 hr. |
| 619 | 14.92 | 2280 1 hr. + 1600 2 hr. + 1800/100 hr. |
| 619 | 7.24 | 2280 1 hr. + 1600 2 hr. + 2000/100 hr. |
| 629 | 7.83 | 2190 1 hr. + 1600 4 Hr. + 1200/100 hr. |
| 629 | 9.21 | 2190 1 hr. + 1600 4 Hr. + 1200/100 hr. |
| 629 | 9.74 | 2190 1 hr. + 1600 4 Hr. + 1400/100 hr. |
| 629 | 6.11 | 2190 1 hr. + 1600 4 Hr. + 1600/100 hr. |
| 629 | 6.25 | 2190 1 hr. + 1600 4 Hr. + 1800/100 hr. |
| 629 | 5.74 | 2190 1 hr. + 1600 4 Hr. + 2000/100 hr. |
| 649 | 27.13 | 2055 1 hr. + 1600 4 hr. + 1200/100 hr. |
| 649 | 28.55 | 2055 1 hr. + 1600 4 hr. + 1200/100 hr. |
| 649 | 35.79 | 2055 1 hr. + 1600 4 hr. + 1400/100 hr. |
| 649 | 31.62 | 2055 1 hr. + 1600 4 hr. + 1400/100 hr. |
| 649 | 31.99 | 2055 1 hr. + 1600 4 hr. + 1600/100 hr. |
| 649 | 25.09 | 2055 1 hr. + 1600 4 hr. + 2000/100 hr. |
| 649 | 27.85 | 2055 1 hr. + 1600 4 hr. + 2000/100 hr. |

Table VII shows that some of the alloys of this invention are comparable to or even exceed the fracture toughness of prior art alloy 996. Table VIII shows that there is very little loss of fracture toughness in alloys of this invention that have been heated for extended periods of time up to 100 hours at temperatures up to at least 1800° F.

The density of the alloys of this invention was determined by comparing the weight of a sample in air to its weight in silicon oil. A nickel sample of 8.88 gm/cm$^3$ density was used as a standard. The density varied from 5.0 gm/cm$^3$ to 6.0 gm/cm$^3$ for different compositions as shown in Table IX below.

TABLE IX

| DENSITY MEASUREMENTS | |
|---|---|
| ALLOY NO. | DENSITY ($gm/cm^3$) |
| 662 | 4.7 |
| 629 | 5.14 |
| 923 | 5.16 |
| 924 | 5.25 |
| 921 | 5.31 |
| 914 | 5.45 |
| 649 | 5.5 |
| 619 | 5.5 |
| 922 | 5.55 |
| 907 | 5.8 |
| 529 | 6.0 |

Figure 8:
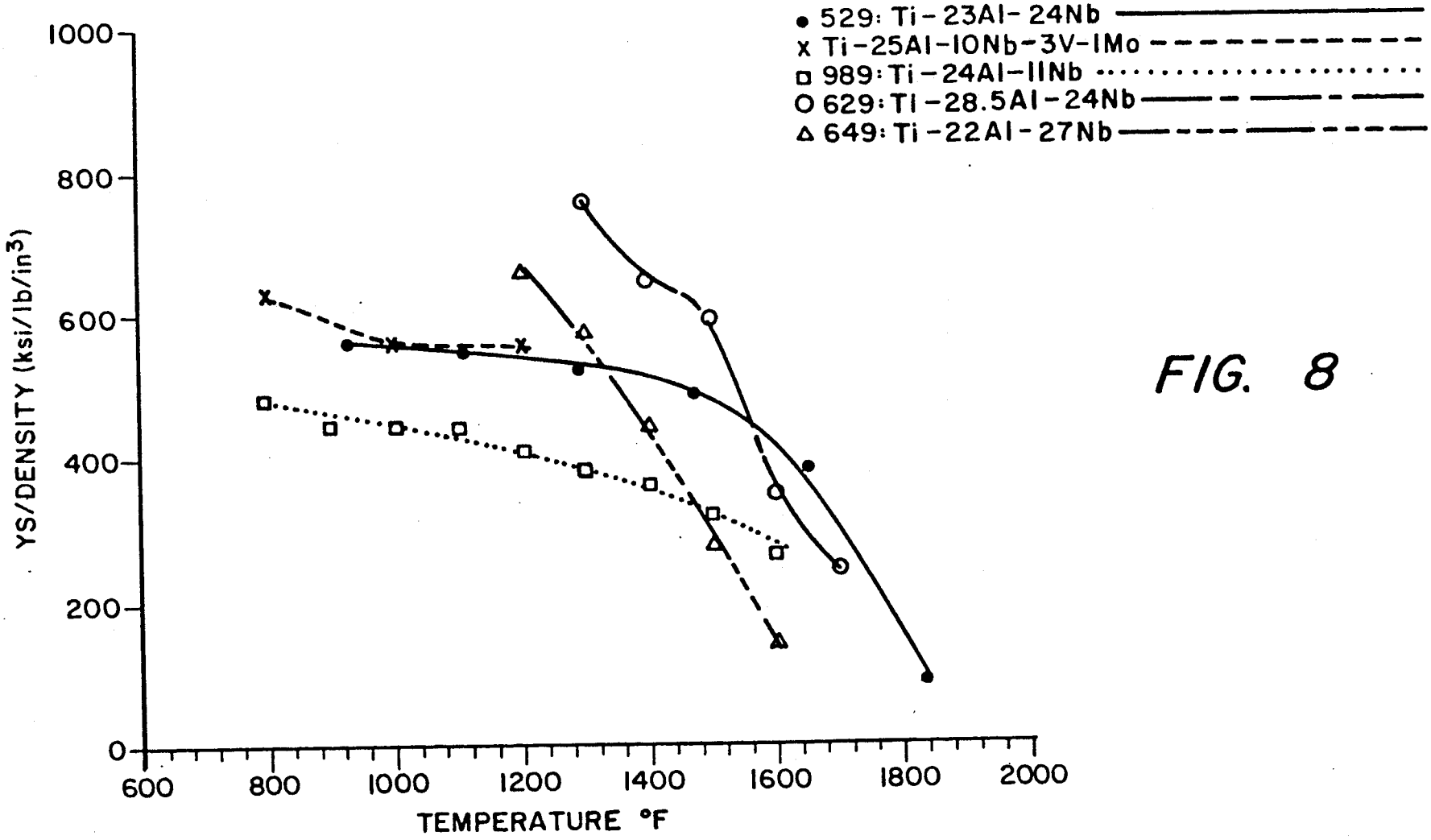
FIG. 8 is a graph comparing the yield strength to density ratio of alloys of this invention to the same ratio for alloys of Blackburn et al..

The density of the Blackburn et al. alloys Ti-24Al-11Nb and Ti-25Al-10Nb-3V-1Mo are known to be 4.7 and 4.64 $gm/cm^3$ respectively. The strength of the alloys of this invention as corrected for the density of the alloys was determined by dividing the yield strength of each alloy by its density. This corrected strength can be compared to the corrected strength of the Blackburn et al. alloys. FIG. 8 shows this comparison of density corrected strength between alloys of this invention and prior art trititanium aluminum alloys. An increase in the yield strength to density ratio is considered an improvement because lighter weight parts can be made that will provide the same strength or load bearing capacity as parts made from denser materials. In a gas turbine lower density parts will produce less centrifugal stress in rotating parts and reduce the overall weight of the gas turbine.

With reference to FIG. 8 it can be seen that the alloys of this invention are improved in the ratio of yield strength to density by at least 50% over prior art trititanium aluminum alloys containing niobium. Some alloys of the present invention even provide an improved yield strength to density ratio over prior art trititanium aluminum alloys containing niobium, vanadium and molybdenum.

The following discussion of the mechanical properties and microstructural ratings shown above and in the figures reveals the criticality of the ranges of titanium, aluminum, and niobium that define the compositions of the alloys of this invention. FIG. 6 displays the higher strength of an alloy of this invention at room temperature and more importantly at temperatures up to at least 1500° F. The strength of this novel alloy is improved over the prior art Ti-Al-Nb and Ti-Al-Nb-V-Mo alloys of Blackburn et al. As a result of this improvement the limited operable temperature range of up to 1110° F. for the prior art trititanium aluminum alloys of Blackburn et al. is improved for the alloys of this invention to temperatures up to at least 1500° F.

The bend tested yield strength and the calculated tensile yield strengths presented in Table IV also demonstrate the improved strength and temperature range of alloys of this invention. For example, alloy 629 has an estimated tensile yield strength of 110 ksi at 1500° F. Compare this to Table II where it is shown the tensile yield strength of prior art reference alloy 989 ranges from 97.8 ksi at room temperature to 52.5 ksi at 1470° F. The estimated tensile yield strength of alloy 629 at 1500° F. is substantially higher than the yield strength of reference alloy 989 at low and elevated temperatures. This is a significant increase in strength over prior Ti-Al-Nb alloys and it increases the useful temperature range in alloys of this invention almost 400° F. Further, this is a useful strength increase because the fracture toughness at room temperature of the alloys of this invention is comparable to prior art Ti-Al-Nb alloys.

In Tables IV and V it can be seen that the outer fiber strain of the alloys of this invention is comparable to the ductility of prior art trititanium aluminum alloys.

The good ductility at elevated temperatures indicates the alloys of this invention will be readily hot forgeable. In fact, blanks produced in the examples above proved to have excellent hot forgeability. Normal hot forging of titanium alloy cylinders into discs is performed by inserting the cylinder in a nickel alloy forging ring to prevent edge cracking in the forged disc. A nickel alloy forging ring was not used in preparing blanks from some of the sample alloys and no edge cracking was experienced during hot forging. The manufacture of gas turbine engine components will be facilitated by such novel and unique hot forging properties.

The microstructure ratings in Table VI were divided into five separate types. Type 1 microstructures were characterized by orthorhombic and Beta phases distributed as a fine two phased, equiaxed or acicular structure containing more Beta phase than in other alloys of this invention. The Beta phase was present in amounts up to about 25 percent while the orthorhombic phase was present as at least about 50 percent of the volume fraction of all phases present. Type 2 microstructures contain little or no Beta phase, were more acicular, and not quite as fine as Type 1 structures. Type 3 microstructures were distinctly acicular and about the size of Type 2 structures. The orthorhombic phase was present as at least about 75 percent of the volume fraction of all phases present in Type 2 microstructures. Type 3 structures did not contain Beta phase but displayed a single phase orthorhombic or mixed alpha-2 and orthorhombic structure that was predominantly orthorhombic. These Type 1-3 structures characterized the alloys of this invention. The alloys having Type 1-3 microstructures and compositions as shown in Table I are shown in Table VI.

Alloys outside the compositions defined by this invention did not display the desirable orthorhombic phase in fine structures that give the alloys of this invention good fracture toughness and superior strength at elevated temperatures. For example, alloys 662, 921, 922, and 924 exhibited a type 4 microstructure. Type 4 microstructures contained phases that could not be determined by metallographic inspection. These undetermined phases were present as acicular structures, patches of two phase possibly eutectoid regions, sharp needle-like phases or fine precipitates. Alloys having Type 4 microstructures have a combination of aluminum and niobium that is higher than the concentration of these elements in the compositions of this invention. The compositions of alloys 662, 921, 922, and 924 are shown in Table I.

Alloy 550 has a combination of aluminum and niobium that is at a lower concentration than the alloys of this invention as shown in Table I. Alloy 550 is characterized by a Type 5 microstructure that is coarser and sharper than the Type 1-3 microstructures. The Type 5 microstructure is a Widmanstatten structure with a coarser spacing of the lathes relative to the structures of compositions of this invention, and is more similar to the microstructure observed in prior art lower niobium Ti-Al-Nb alloys. Alloy 550 also included regions of fine parallel lath growth within Widmanstatten transformed grains. These regions are generally associated with brittle mechanical behavior.

Therefore, the compositions of the alloys of this invention define critical ranges of titanium, aluminum, and niobium that produce a new orthorhombic phase in a desirable finer microstructure than prior trititanium aluminum alloys containing niobium.

The microstructure ratings also showed the alloys of this invention will remain stable during long time inert gas exposure at elevated temperatures up to at least 1500° F. Long time service at these temperatures in air or combustion gases will require protective coatings. However, the extension of the operating range of these alloys to 1500° F. is a significant improvement over the 1110° F. operating range of the alloys of Blackburn et al..

Comparison of the microstructure with the mechanical properties of alloys of this invention revealed the Type 1–3 structures were each characteristic of some improvement in certain mechanical properties. Alloys which had the best fracture toughness but lower yield strength had the Type 1 microstructure. These alloy compositions are shown as the shaded area in the triaxial plot of FIG. 2. Alloys having the highest yield strength but lower fracture toughness were characterized by the Type 3 microstructure. These alloy compositions are shown as the shaded area in the triaxial plot of FIG. 3. Alloys combining high yield strength and acceptable fracture toughness were characterized by the Type 2 microstructure. These alloy compositions are shown as the shaded area in the triaxial plot of FIG. 4.

Fracture toughness, $K_Q$, as shown in Tables VII and VIII is comparable to or better than prior art Ti-Al-Nb alloys. Generally as the yield strength of the alloys of this invention increases the fracture toughness decreases. However, when a significant advantage in strength is shown over prior Ti-Al-Nb alloys, fracture toughness is at least comparable. When yield strength is only slightly higher than prior trititanium aluminum alloys containing niobium, fracture toughness is significantly higher in alloys of this invention. It is significant to note that fracture toughness as high as 35.79 ksi times square root inch was found in alloys of this invention. This is a significant improvement over the 10–20 ksi times square root inch fracture toughness of prior trititanium aluminides. As a result, the alloys of this invention have more possible applications in gas turbines than prior trititanium aluminum alloys containing niobium.

The fracture toughness measurements shown in Table VIII also demonstrate the structural stability of the alloys of this invention. Notched bars heated for extended time periods of up to 100 hours at temperatures up to at least 1800° F. showed that there is very little loss in fracture toughness in the alloys tested in Table VIII when exposed to high temperatures for extended time periods. This indicates that the microstructure remains fairly stable without much formation of embrittling phases and precipitates in the alloys of this invention when exposed to high temperatures for extended time periods.

FIG. 8 shows the improved density corrected strength of the alloys of this invention. Alloys 529, 629 and 649 show an improvement over prior art Ti-Al-Nb alloys of over 50% in the density corrected strength. Alloys 629 and 649 even show significant improvement in the density corrected strength over the prior art Ti-Al-Nb-V-Mo alloy at temperatures up to 1300° F. and higher. As explained previously the yield strength data for the prior art Ti-Al-Nb-V-Mo alloy was taken from the disclosure of Blackburn et al. in the '020 patent. The '020 patent only reveals the yield strength of the Ti-Al-Nb-V-Mo alloy up to 1200° F., however above this temperature yield strength is expected to drop rapidly. It is significant to note that the $Ti_3Al$ alloys of this invention containing a single additive, niobium, are comparable to, or even exceed the density corrected yield strength of the trititanium aluminum alloy of Blackburn et al. '020 containing 3 additives, niobium, vanadium, and molybdenum.

The annealing times and temperatures used in the preceding examples were chosen based upon the earliest knowledge of the properties of the alloys of this invention. It is fully expected that with further research into the diffusion kinetics and reaction of the microstructure to thermo-mechanical processing still further improvements in the mechanical properties of the alloys of this invention will be achieved. This has been demonstrated in other titanium aluminum alloys as different solutioning, cooling, and hot forge annealing techniques have been developed.

It will be obvious to those skilled in the art that additional variations in the alloys of this invention may be made without departing from the scope of this invention which is limited only by the appended claims.

What is claimed is:

1. A titanium aluminum alloy, comprising titanium, aluminum and niobium in the approximate atomic percentages shown as the hatched area in FIG. 1 with the niobium being at least 18 percent, said alloy having a high yield strength at temperatures up to at least 1500° F. and good fracture toughness.

2. The titanium aluminum alloy of claim 1 said alloy being forgeable at temperatures from 1700° F. to 2000° F.

3. The titanium aluminum alloy of claim 1 further characterized by an orthorhombic phase comprising at least about 50% of the volume fraction of all phases present in the microstructure of said alloys.

4. A titanium aluminum alloy, comprising titanium, aluminum and niobium in the approximate atomic percentages shown as the hatched area in FIG. 2 with the niobium being at least 18 percent, said alloy having a high yield strength at temperatures up to at least 1500° F. and superior fracture toughness.

5. The titanium aluminum alloy of claim 4 said alloy being forgeable at temperatures from 1700° F. to 2000° F.

6. The titanium aluminum alloy of claim 4 further characterized by an orthorhombic phase comprising at least about 50% of the volume fraction of all phases present in the microstructure of said alloy.

7. A titanium aluminum alloy, comprising titanium, aluminum and niobium in the approximate atomic percentages shown as the hatched area in FIG. 3 with the niobium being at least 18 percent said alloy having superior yield strength at temperatures up to at least 1500° F. and good fracture toughness.

8. The titanium aluminum alloy of claim 7 said alloy being forgeable at temperatures from 1700° F. to 2000° F.

9. The titanium aluminum alloy of claim 7 further characterized by an orthorhombic phase comprising at least about 50% of the volume fraction of all phases present in the microstructure of said alloy.

10. A titanium aluminum alloy, comprising titanium, aluminum and niobium in the approximate atomic percentages shown as the hatched area in FIG. 4 with the niobium being at least 18 percent; said alloy having a superior combination of fracture toughness, and high yield strength at temperatures up to at least 1500° F.

11. The titanium aluminum alloy of claim 10 said alloy being forgeable at temperatures from 1700° F. to 2000° F.

12. The titanium aluminum alloy of claim 10 further characterized by an orthorhombic phase comprising at least about 50% of the volume fraction of all phases present in the microstructure of said alloy.

13. A gas turbine engine component formed from an alloy, comprising titanium, aluminum, and niobium in the approximate atomic percentages shown as the hatched area in FIG. 1 with the niobium being at least 18 percent.

14. The gas turbine engine component of claim 13 wherein said alloy is comprised of titanium, aluminum and niobium in the approximate atomic percentages shown as the hatched area in FIG. 2.

15. The gas turbine engine component of claim 13 wherein said alloy is comprised of titanium, aluminum and niobium in the approximate atomic percentages shown as the hatched area in FIG. 3.

16. The gas turbine engine component of claim 13 wherein said alloy is comprised of titanium, aluminum and niobium in the approximate atomic percentages shown as the hatched area in FIG. 4.

17. Articles having high yield strength at elevated temperatures up to at least 1500° F. and good fracture toughness formed from an alloy, comprising titanium, aluminum and niobium in the approximate atomic percentages shown as the hatched area in FIG. 1 with the niobium being at least 18 percent.

18. The article of claim 17 having high yield strength at elevated temperatures up to at least 1500° F. and superior fracture toughness formed from said alloy wherein the titanium, aluminum and niobium are in the approximate atomic percentages shown as the hatched area in FIG. 2.

19. The article of claim 17 having superior strength at elevated temperatures up to at least 1500° F. and good fracture toughness formed from said alloy wherein the titanium, aluminum and niobium are in the approximate atomic percentages shown as the hatched area in FIG. 3.

20. The article of claim 17 having a superior combination of fracture toughness, and high yield strength at temperatures up to at least 1500° F. formed from said alloy wherein the titanium, aluminum and niobium are in the approximate atomic percentages shown as the hatched area in FIG. 4.

21. A titanium aluminum alloy, comprising in atomic percent:

about 18 to 30 percent aluminum; and about 18 to 34 percent niobium with the balance essentially titanium;

said alloy having a high yield strength at temperatures up to at least 1500° F. and good fracture toughness.

22. A titanium aluminum alloy, comprising in atomic percent:

about 18 to 25.5 percent aluminum; and about 20 to 34 percent niobium with the balance essentially titanium;

said alloy having a high yield strength at temperatures up to at least 1500° F. and superior fracture toughness.

23. A titanium aluminum alloy, comprising in atomic percent:

about 23 to 30 percent aluminum; and about 18 to 28 percent niobium with the balance essentially titanium;

said alloy having a superior yield strength at temperatures up to at least 1500° F. and good fracture toughness.

24. A titanium aluminum alloy, comprising in atomic percent:

about 21 to 26 percent aluminum; and about 19.5 to 28 percent niobium with the balance essentially titanium;

said alloy having a superior combination of fracture toughness, and high yield strength at temperatures up to at least 1500° F.

25. A gas turbine engine component formed from an alloy, comprising in atomic percent:

about 18 to 30 percent aluminum; and about 18 to 34 percent niobium with the balance essentially titanium.

* * * * *